US009628917B2

(12) United States Patent
Pircaro

(10) Patent No.: US 9,628,917 B2
(45) Date of Patent: Apr. 18, 2017

(54) SOUND PRODUCING SYSTEM

(71) Applicant: Bose Corporation, Framingham, MA (US)

(72) Inventor: Mark Pircaro, Yuma, AZ (US)

(73) Assignee: Bose Corporation, Framingham, MA (US)

( * ) Notice: Subject to any disclaimer, the term of this patent is extended or adjusted under 35 U.S.C. 154(b) by 205 days.

(21) Appl. No.: 14/339,071

(22) Filed: Jul. 23, 2014

(65) Prior Publication Data

US 2016/0029128 A1 Jan. 28, 2016

(51) Int. Cl.

| | |
|---|---|
| ***H04R 9/06*** | (2006.01) |
| ***H04R 9/00*** | (2006.01) |
| ***H04R 7/06*** | (2006.01) |
| ***H04R 7/14*** | (2006.01) |
| ***H04R 7/24*** | (2006.01) |
| *H04R 7/12* | (2006.01) |

(52) U.S. Cl.

CPC ..... *H04R 9/00* (2013.01); *H04R 7/06* (2013.01); *H04R 7/14* (2013.01); *H04R 7/24* (2013.01); *H04R 7/122* (2013.01); *H04R 9/06* (2013.01); *H04R 2207/021* (2013.01); *H04R 2307/207* (2013.01)

(58) Field of Classification Search

CPC ..... H04R 7/045; H04R 7/06; H04R 7/122; H04R 7/14; H04R 7/24; H04R 9/046; H04R 9/06; H04R 2207/021; H04R 2307/201; H04R 2307/207; H04R 2440/07

USPC ..... 381/152, 337, 353, 396, 398, 423, 424, 381/425, 426, 430; 181/157, 163, 164, 181/167, 173, 174

See application file for complete search history.

(56) References Cited

U.S. PATENT DOCUMENTS

| | | | |
|---|---|---|---|
| 728,382 | A | 5/1903 | English |
| 1,917,013 | A | 12/1930 | Bostwick |
| 1,870,417 | A | 8/1932 | Mallina |
| 1,990,409 | A | 2/1933 | Lawrence |
| 2,657,758 | A | 3/1950 | Varnet |
| 2,531,634 | A | 11/1950 | Lawrence |
| 3,073,411 | A | 1/1963 | Bleazey et al. |
| 3,464,514 | A | 9/1969 | Mochida et al. |

(Continued)

FOREIGN PATENT DOCUMENTS

| | | |
|---|---|---|
| GB | 282296 | 6/1927 |
| JP | 08168092 | 6/1996 |

(Continued)

OTHER PUBLICATIONS

International Search Report and Written Opinion dated Oct. 12, 2015 for International application No. PCT/US2015/041310.

*Primary Examiner* — Huyen D Le

(57) ABSTRACT

Breakup of an electro-acoustic transducer is disrupted by introducing discontinuities that do not conform to a configuration having n-fold radial symmetry. This may be accomplished by using irregular azimuthal spacing and/or by having a junction point of the discontinuities offset relative to the geometric center of the moving surface. The discontinuities may be implemented on one or more of the moving sound producing components, such as on a diaphragm and/or dust cap of the electro-acoustic transducer. A bridging member may be introduced to span the discontinuities to stiffen the sound producing components.

12 Claims, 12 Drawing Sheets

(56) References Cited

U.S. PATENT DOCUMENTS

| | | | | |
|---|---|---|---|---|
| 3,983,337 | A | 9/1976 | Babb | |
| 4,115,667 | A | 9/1978 | Babb | |
| 4,205,205 | A | 5/1980 | Babb | |
| 4,699,242 | A | 10/1987 | Ono | |
| 6,154,557 | A | 11/2000 | Montour et al. | |
| 6,176,345 | B1 | 1/2001 | Perkins et al. | |
| 6,863,153 | B1 | 3/2005 | Hayakawa | |
| 6,920,957 | B2 | 7/2005 | Usuki et al. | |
| 7,120,263 | B2 | 10/2006 | Azima et al. | |
| 7,306,073 | B2 | 12/2007 | Frasl | |
| 7,315,628 | B2 | 1/2008 | Kuribayashi et al. | |
| 7,599,511 | B2 | 10/2009 | Corynen | |
| 7,866,439 | B2 * | 1/2011 | Windischberger ..... | H04R 7/20 181/157 |
| 8,085,968 | B2 | 12/2011 | Silver | |
| 8,315,419 | B2 | 11/2012 | Graff et al. | |
| 8,345,916 | B2 | 1/2013 | Schulze et al. | |
| 2005/0078850 | A1 | 4/2005 | Norton | |
| 2007/0053547 | A1 | 3/2007 | Ando | |
| 2008/0232633 | A1 | 9/2008 | Corynen | |

FOREIGN PATENT DOCUMENTS

| | | | |
|---|---|---|---|
| JP | 09224297 | | 8/1997 |
| JP | 2007306237 | A | 11/2007 |
| JP | 2012109859 | A | 6/2012 |
| WO | 9839947 | A1 | 9/1998 |

* cited by examiner

SOUND PRODUCING SYSTEM

BACKGROUND

This disclosure relates to audio systems and related devices and methods, and, particularly, to a moving surface of an electro-acoustic transducer.

SUMMARY

All examples and features mentioned below can be combined in any technically possible way.

In one aspect an electro-acoustic transducer includes a moving surface, and at least two discontinuities formed in or in contact with the moving surface, the at least two discontinuities not conforming to a pattern of n-fold radial symmetry.

In some implementations, the at least two discontinuities are irregularly spaced in an azimuthal manner and intersect at a junction that is substantially coincident with a geometric center of the moving surface.

In certain implementations, the at least two discontinuities intersect at a junction that is not substantially coincident with a geometric center of the moving surface of the electro-acoustic transducer. In some implementations, the at least two discontinuities may be irregularly spaced in an azimuthal manner. In other implementations, the at least two discontinuities may be regularly spaced in an azimuthal manner.

In some implementations, the at least two discontinuities include at least four discontinuities, at least a first two of the at least four discontinuities being formed to intersect at a first junction, and at least a second two of the at least four discontinuities being formed to intersect at a second junction. In certain implementations, the first junction is coincident with a geometric center of the moving surface of the electro-acoustic transducer and the second junction is not coincident with the geometric center of the moving surface of the electro-acoustic transducer.

In some implementations, the electro-acoustic transducer further includes a voice coil bobbin attached to the moving surface, the voice coil bobbin being centered about a location offset from a geometric center of the moving surface. In certain implementations, the at least two discontinuities intersect at a junction that is substantially coincident with the location offset from the geometric center of the moving surface about which the voice coil bobbin is centered.

In certain implementations, each of the discontinuities is substantially straight to radiate from at least one junction toward an edge of the moving surface to disrupt breakup of the moving surface. In some implementations, each of the discontinuities extends a different distance from the at least one junction toward the edge of the moving surface. In certain implementations, each of the discontinuities extends from the at least one junction to the edge of the moving surface.

In some implementations, the at least two discontinuities formed in or in contact with the moving surface are formed to radiate from a voice coil attachment region.

In certain implementations, the electro-acoustic transducer further includes a second set of discontinuities formed within the voice coil attachment region, the second set of discontinuities extending only within the voice coil attachment region, being independent of the at least two discontinuities, and not conforming to a pattern of n-fold radial symmetry.

In some implementations, the at least two discontinuities are formed within the moving surface, and wherein the electro-acoustic transducer further includes a stiffening member connected to the moving surface to span a junction between the at least two discontinuities.

In another aspect an electro-acoustic transducer includes a moving surface having first and second transverse sections interconnecting first and second hemi-circular end sections, a motor to move the moving surface to create acoustic waves, and at least two discontinuities formed in or in contact with the moving surface. The at least two discontinuities radiate from at least one discontinuity junction toward an edge of the moving surface to disrupt breakup of the moving surface. The at least two discontinuities being constructed to not exhibit n-fold radial symmetry within the moving surface.

In certain implementations, the at least two discontinuities include a first pair of discontinuities extending along a first major axis from the first hemi-circular end section to the second hemi-circular end section, and a second pair of discontinuities bisecting the moving surface and the first pair of discontinuities and extending transverse to the first pair of discontinuities at an intersection angle substantially other than 90 degrees.

In some implementations, the intersection angle is between 110 and 135 degrees.

In certain implementations, the second pair of discontinuities extends from a first intersection between the first transverse section and the first hemi-circular end section to a second intersection between the second transverse section and the second hemi-circular end section.

In some implementations, the moving surface includes a concave surface comprising sections that are nominal sections of a sphere.

In certain implementations, the electro-acoustic transducer further includes a voice coil attached to the moving surface at an off-center location.

In some implementations, the first and second pairs of discontinuities are formed as ribs in the concave surface.

In certain implementations, the electro-acoustic transducer further includes a reinforcing member at an intersection between the first and second pairs of discontinuities. In some implementations, the reinforcing member is connected to the concave surface at four corners defined by the intersecting first and second pairs of discontinuities.

In another aspect a dust cap for an electro-acoustic transducer includes a central area, and a plurality of wings extending outwardly from the central area to engage a surface of a diaphragm of the electro-acoustic transducer, the plurality of wings extending at relative azimuthal orientations substantially other than 90 degrees.

In some implementations, at least one of the plurality of wings has a height different than a height of at least one of the other of the plurality of wings to enable differentiated engagement of the wings with the surface of the diaphragm.

DETAILED DESCRIPTION

This disclosure is based, at least in part, on the realization that it is possible to disrupt vibro-mechanical breakup of an electro-acoustic transducer by introducing discontinuities that do not conform to a configuration having n-fold radial symmetry. This may be accomplished, as described herein, by using irregular azimuthal spacing and/or by having a junction point of the discontinuities offset relative to the geometric center of the moving surface (with regular or irregular azimuthal spacing). The discontinuities may be implemented on one or more of the moving sound producing components, such as on a diaphragm and/or dust cap of the electro-acoustic transducer.

Figure 1:
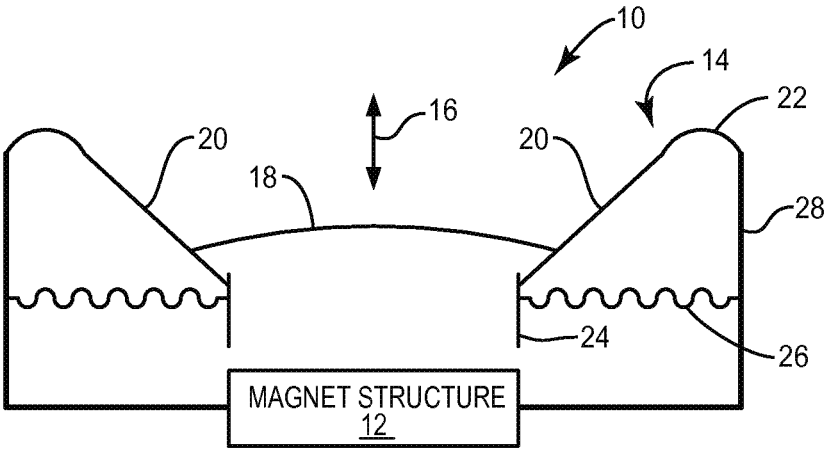
FIG. 1 is a cross-sectional view of an example electro-acoustic transducer.

FIG. 1 shows a cross-sectional view of an example electro-acoustic transducer. As shown in FIG. 1, the electro-acoustic transducer 10 includes an electromagnetic motor formed of a magnet structure 12 and a voice coil 24 that is used to move moving sound producing components 14 of the electro-acoustic transducer in a back and forth direction 16 to create acoustic waves. Other motors may be utilized as well, such as piezoelectric or electrostatic, and the implementation shown in FIG. 1 is merely one example electroacoustic transducer. The moving sound producing components in this example include components such as a dust cap 18, diaphragm 20, and surround 22. As such, the moving surface of the electro-acoustic transducer includes surfaces of one or more of a dust cap 18, diaphragm 20, and at least part of surround 22. Other electro-acoustic transducers may have different sets of moving sound producing components and the example shown in FIG. 1 is merely one implementation. For example, other electro-acoustic transducers may be configured where the dust cap and diaphragm are a single, continuous unit. Dome radiating tweeters and midranges are examples of this, as are electro-acoustic transducers with laminated planar moving surfaces. Likewise other electro-acoustic transducers may also have multiples of any of the sound producing components making up the moving surface, and may also have multiple motors.

The voice coil 24 is attached to the moving sound producing components 14 and is supported by a spider 26. The spider supports the voice coil relative to a basket 28. In operation, the magnetic structure 12 causes voice coil 24 to move in the back and forth direction 16. Movement of the voice coil is imparted to the moving surface of the moving sound producing components of the electro-acoustic transducer to enable the electro-acoustic transducer to create acoustic waves. In some implementations, the electro-acoustic transducer may have only a surround 22, and not a spider 26, or the reverse. It may also have multiples of either or both.

The moving surface of the electro-acoustic transducer moves in a pistonic manner when generating sounds at lower frequencies. As the frequency of the sound being reproduced by the electro-acoustic transducer increases, the moving surface will reach a point where it no longer moves in a pistonic manner. This point is referred to herein as vibro-mechanical breakup, or simply "breakup" hereafter. When the moving surface is going into breakup, not all portions of the moving surface vibrate with the same phase. In other words, different points on the moving surface are not moving in unison. To enable a wide range of frequencies to be generated by the electro-acoustic transducer, it is often desirable for the breakup frequency to be as high as possible.

One result of breakup is that the moving surface may tend to oscillate at one or more eigen-frequencies that will cause the overall frequency response of the acoustic transducer to be degraded, and may result in distortion to the sound output by the electro-acoustic transducer.

It is possible to decompose vibro-mechanical breakup into modes with radial and circumferential components. Radial breakup is used herein to refer to resonant modes that occur in connection with propagation of mechanical waves that are primarily radial within the moving surface. Likewise circumferential breakup is used herein to refer to resonant modes that occur in connection with propagation of mechanical waves that are primarily circumferential within the moving surface.

To obtain a smoother frequency response and reduce the effects of distortion due to breakup, according to an example, geometrical irregularities are introduced into the moving sound producing components of the electro-acoustic transducer to disrupt the circumferential component of breakup. Disrupting the circumferential component of breakup was found to also interfere with radial components of breakup. By increasing the complexity of the moving surface's mechanical vibratory behavior, it is possible to smooth the electro-acoustic transducer's frequency response, and reduce distortion to the sound output by the electro-acoustic transducer.

The discontinuities described herein may be spaced at irregular intervals such that at least two different azimuthal spacings are formed between pairs of discontinuities, as such intervals would be considered from the planar-projected geometric center of the diaphragm and/or the dust cap when viewed from the front or rear of the moving surface. The discontinuities may be substantially radial in orientation, but may also be oblique with respect to a radial or azimuthal orientation as shown in FIGS. 8-14. Further, as shown in FIG. 11, the discontinuities may join at a location offset from a geometric center of the moving surface or at more than one center. In the example where the discontinuities join at a location offset from the geometric center of the moving surface or at more than one center, the discontinuities may be spaced at regular intervals. Including the irregular discontinuities (whether spaced at irregular intervals and/or joined at a location offset from the geometric center of the moving surface) in the diaphragm enables quasi-chaotic disturbance of the breakup to occur, thereby smoothing the frequency response from the electro-acoustic transducer during breakup. Specifically, by introducing discontinuities into the moving surface, propagation of energy within the moving surface will be altered, thereby altering and making more complex the modality of breakup of the moving surface. In addition, in a moving surface having irregular discontinuities, the reflections caused by the discontinuities may quasi-chaotically interfere to significantly suppress breakup resonances and thereby smooth the overall frequency response of the moving surface.

Figure 2A:
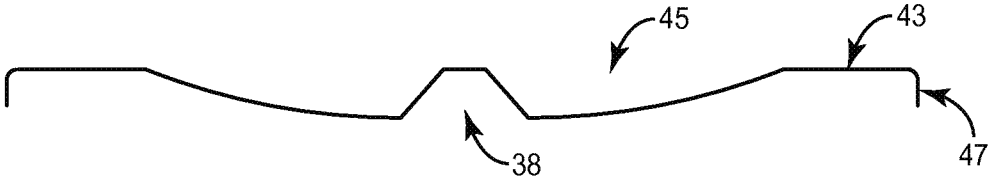
FIG. 2A is a cross-sectional view of the example diaphragm of FIG. 2 taken along line 2A-2A in FIG. 2.
Figure 2B:
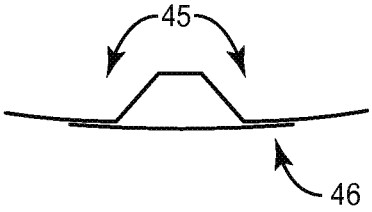
FIG. 2B is a cross-sectional view of the example diaphragm of FIG. 2 taken along line 2B-2B in FIG. 2.
Figure 2:
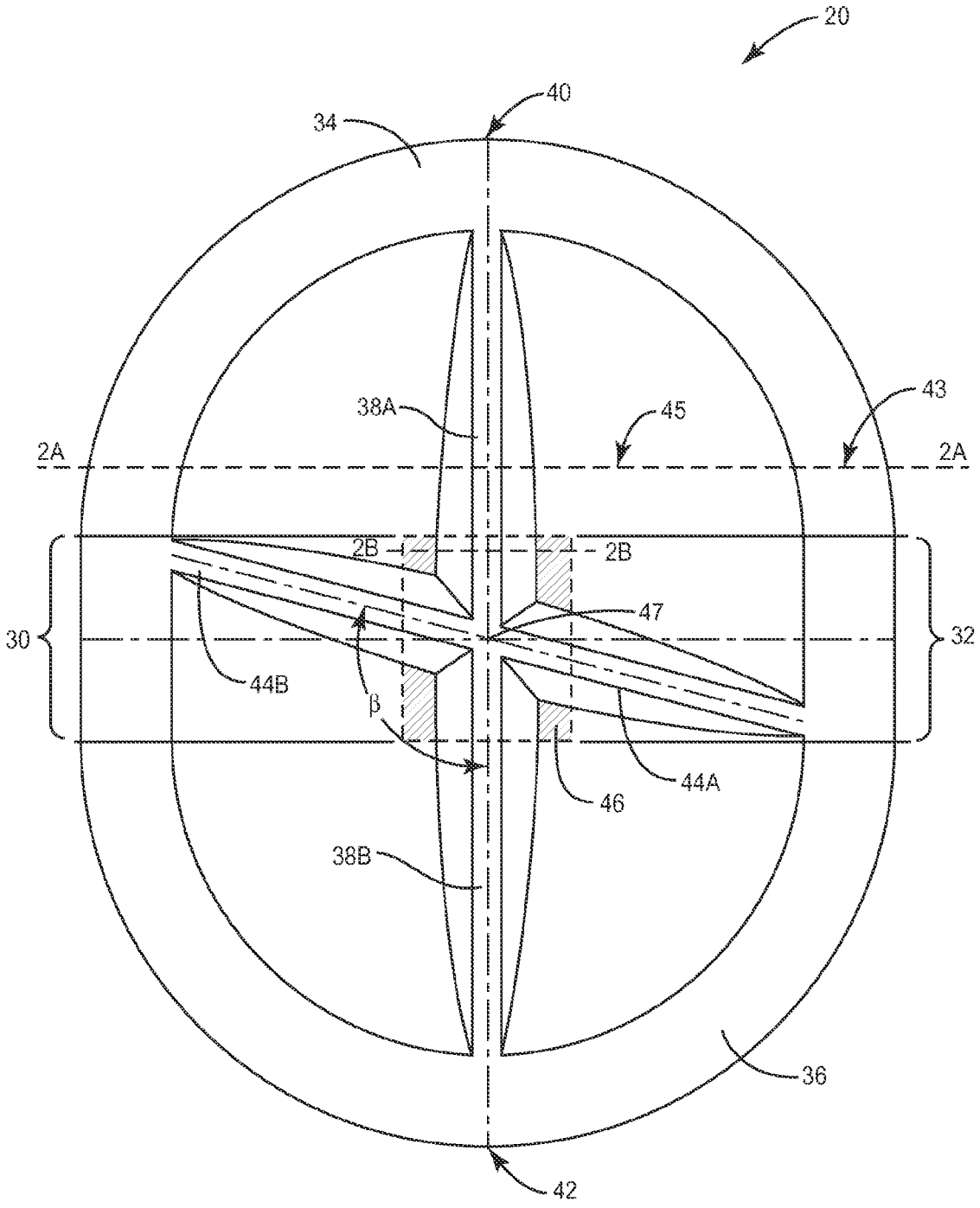
FIG. 2 is a plan view of an example diaphragm for use in an electro-acoustic transducer.

FIG. 2 shows an example diaphragm 20 for use in an electro-acoustic transducer according to an implementation. As shown in FIG. 2, the diaphragm in this example is racetrack shaped with transverse sections 30, 32 and hemicircular (half circle) end sections 34, 36. In other implementations other shapes may be utilized, including but not limited to a circle, or ellipse, square, rectangle, or other oblong shape. The transverse sections 30, 32 may be substantially flat. In one implementation, as shown in FIGS. 2 and 2A, the moving surface of the electro-acoustic transducer may be formed to be concave when viewed from the top and, optionally, may be formed using concatenated spherical and cylindrical sections. Specifically, in one implementation a portion of the surface extending between transverse sections 30, 32 is a nominal section of a cylinder and portions of the surface described by hemi-circular end sections 34, 36 are nominal sections of a sphere. In other implementations other shapes may be utilized. The diaphragm could be constructed of aluminum, paper, or other suitable materials.

FIG. 2A shows a cross-sectional view of the example diaphragm shown in FIG. 2 taken along line 2A-2A. As shown in FIG. 2A, areas 43 outside concave sections 45 may be substantially flat with an outer perimeter 47 used to attach to a surround. Other profiles and shapes may be used to implement the diaphragm 20 of the example shown in FIG. 2 (for example, a convex moving surface may be used) and the illustrated example will be used to explain operation of an implementation.

In an implementation, a first pair of discontinuities 38A, 38B extend in a longitudinal direction along a major axis from hemi-circular end section 34 to hemi-circular end section 36. In the example where the diaphragm has a concave moving surface, the first pair of discontinuities 38A, 38B may extend from an apex 40 of hemi-circular end section 34 to apex 42 of hemi-circular end section 36. The first pair of discontinuities 38A, 38B bisect the diaphragm in the longitudinal direction. A second pair of discontinuities 44A, 44B extends from an intersection of transverse section 30 and hemi-circular end section 34 to the intersection of transverse section 32 and hemi-circular end section 36. The discontinuities 38A, 38B, 44A, 44B in this example, have a junction point 47 coincident with a geometric center of diaphragm 20.

The discontinuities 38A, 38B, 44A, 44B, may be ribs or protrusions, generally protruding from the concave surface 45 of the diaphragm, or the discontinuities 38A, 38B, 44A, 44B may be grooves or indentations, generally recessing from the concave surface 45 of the diaphragm, or any combination thereof. As shown in FIGS. 2A and 2B, a cross-section of the discontinuities may be generally V-shaped, with the apex of the V cropped. However, other shapes could be used for the discontinuities when viewed in cross-section, including but not limited to a generally U-shaped cross-section, V-shaped cross-section, V-shaped cross-section with a rounded tip, and square-shaped cross-section with rounded edges. The discontinuities may be straight or curved. The radius of curvature along the length of the discontinuity can be infinite (i.e. a straight line), a finite constant, or smoothly or otherwise varying. Other geometric aspects of the discontinuities may be constant or may vary along the length of the discontinuity. The depth or height of the discontinuity relative to the diaphragm may vary as the discontinuity traverses along the major axis of the diaphragm. For example, the depth or height of a discontinuity may range from zero depth at the apexes 40, 42 of hemi-circular end sections 34, 36 to a maximum depth somewhere between the apexes 40, 42. In other examples, the discontinuity depth may remain constant over a large portion of the length of the discontinuity, or may have a plurality of local maxima and minima along the discontinuity path, forming undulations in the bottom of the discontinuity.

Figure 7:
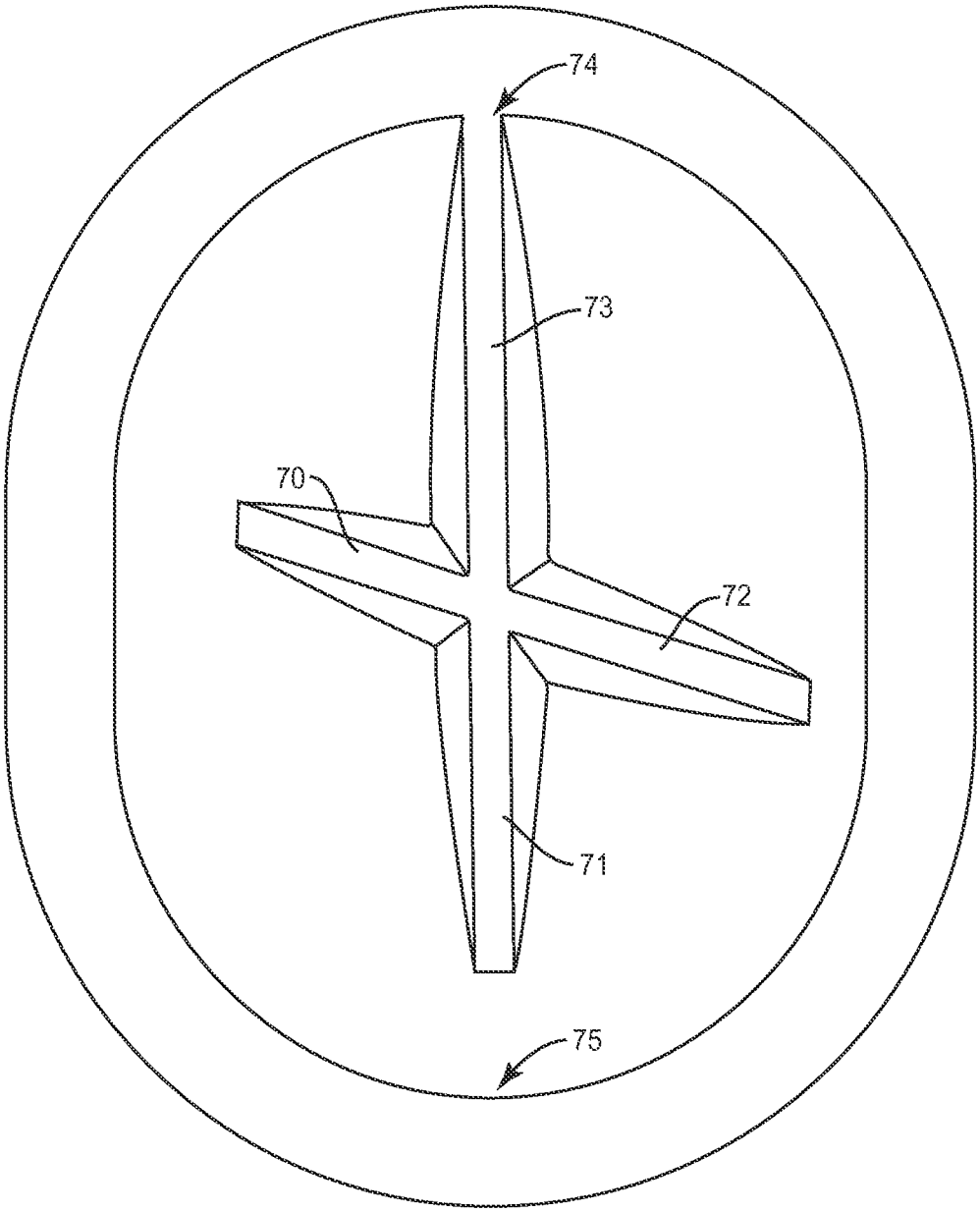
FIGS. 7-10 are plan views of example diaphragms for use in an electro-acoustic transducer.

Although the illustrated example has the second pair of discontinuities extending between the intersections of the transverse sections 30, 32 and respective hemi-circular end sections 34, 36, other implementations may be formed such that the discontinuities extend toward other locations on the edge of the diaphragm. Likewise, although the discontinuities in the example shown in FIG. 2 end at the edge of substantially flat section 43, other implementations may extend the discontinuities into the substantially flat area or truncate the discontinuities within the concave portions of the diaphragm to not extend all the way to the edge of the substantially flat section, for example as shown in FIG. 7. Although two pairs of radially opposed discontinuities are shown in FIG. 2, any number of discontinuities could be used. Where the discontinuities are joined at a junction that is coincident with a geometric center of the diaphragm, the discontinuities should be irregularly spaced in an azimuthal direction to prevent n-fold azimuthal symmetry.

In an implementation such as shown in FIG. 2, where two pairs of discontinuities are formed on the diaphragm, the second pair of discontinuities 44A, 44B bisects the diaphragm such that an angle $\beta$ between a discontinuity of the first pair of discontinuities and a discontinuity of the second pair of discontinuities is substantially not 90°. Example values for the angle $\beta$ may be on the order of between 110° and 135°. Other values may be used as well. More generally, where more than two discontinuities are formed on the diaphragm, an angle between adjacent discontinuities substantially differs, such that the discontinuities that intersect at the geometric center of the diaphragm are not spaced at substantially regular intervals. For example, where three pairs of discontinuities are formed on the diaphragm, at least one of the angles between adjacent discontinuities would be substantially other than 60°.

The voice coil may be attached to the diaphragm shown in FIG. 2 at any location, such as at the center of the moving surface or at a location of the moving surface that is off-center. Attaching the voice coil at a location that is off-center, when combined with discontinuities in the moving surface, may enhance breakup characteristics to a greater extent than inclusion of discontinuities alone.

Including discontinuities in the moving surface may cause breakup to occur at a different frequency than would normally occur in a moving surface without discontinuities. Specifically, in an implementation without discontinuities in the moving surface, movement of the voice coil causes largely in-plane stresses within the diaphragm, causing the diaphragm to have a relatively high breakup frequency, e.g. a breakup frequency on the order of approximately 17 kHz. Forming discontinuities 38, 44 into the diaphragm in the manner discussed above may cause the in-plane stresses within the diaphragm to be converted to bending stresses that, in some implementations, may cause breakup to occur at a different frequency. Despite the change in breakup frequency, due to the quasi-chaotic nature of the breakup introduced by the discontinuities, the overall response of the electroacoustic transducer may be smoothed when compared with a moving surface without discontinuities.

Figure 10A:
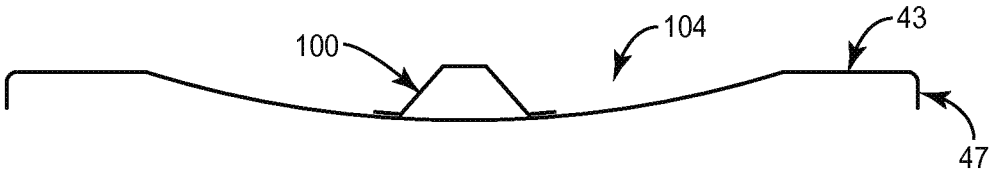
FIG. 10A is a cross-sectional view of the example diaphragm of FIG. 10 taken along line 10A-10A in FIG. 10.
Figure 10:
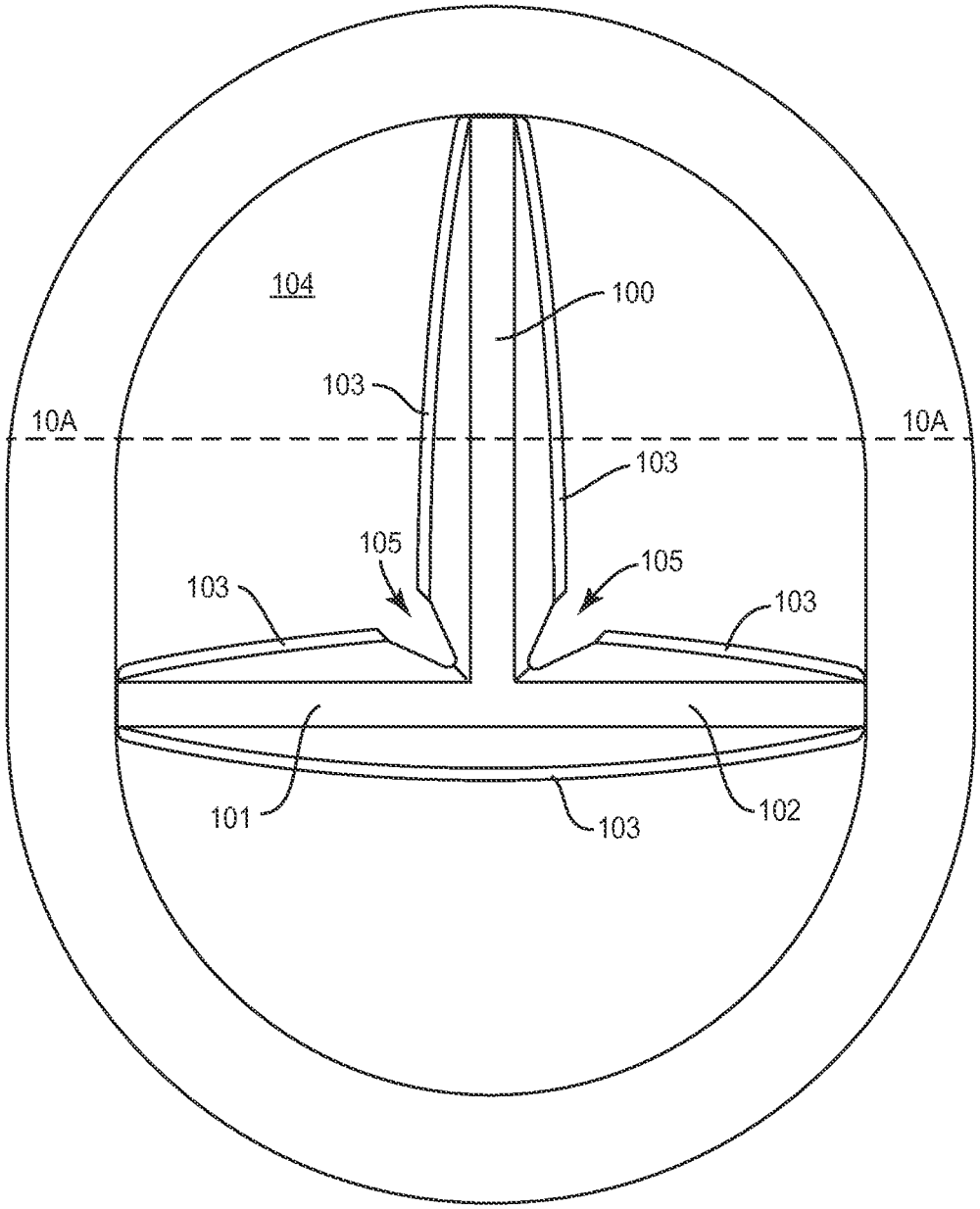
Figure 11:
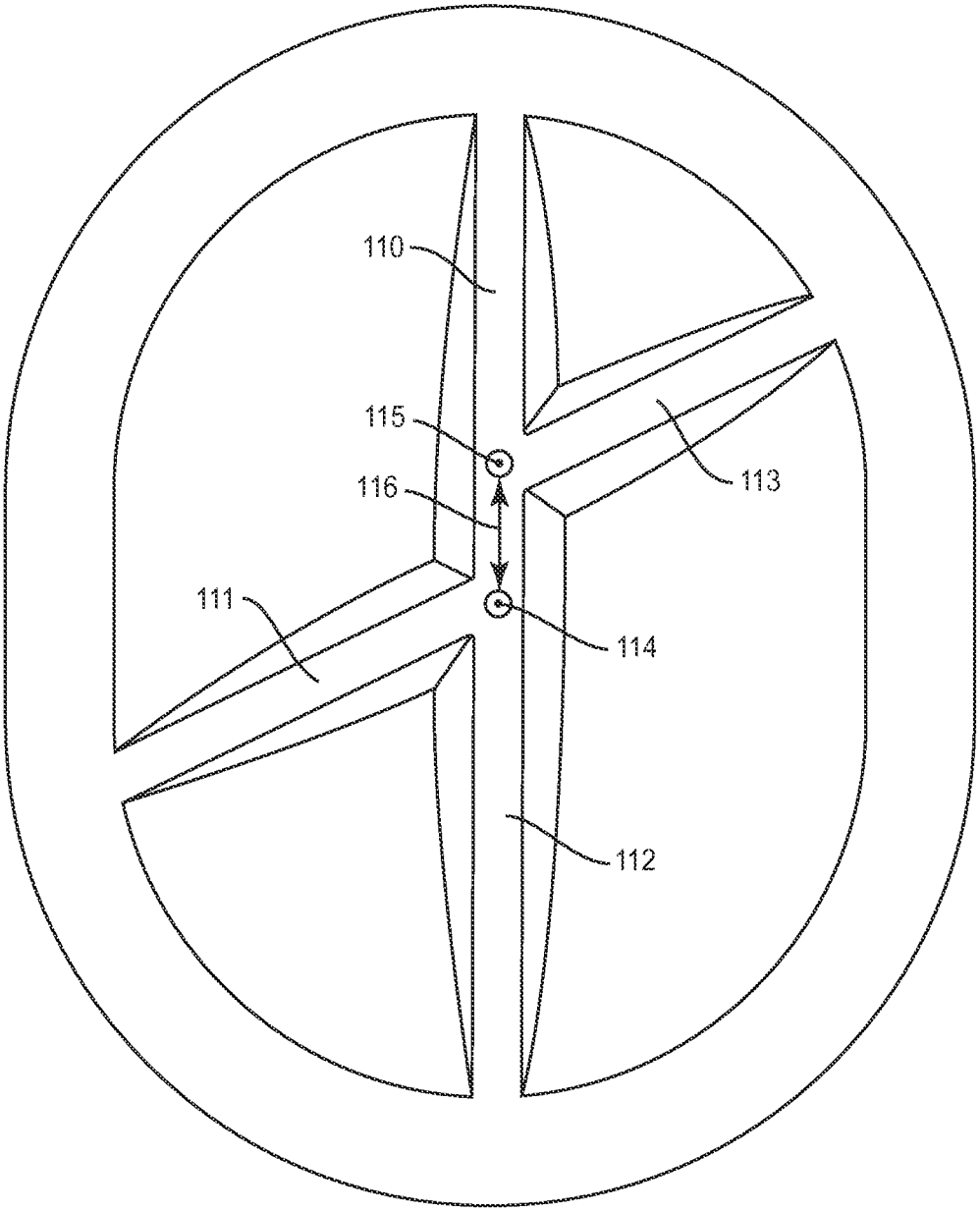
FIGS. 11-14 are plan views of example diaphragms for use in an electro-acoustic transducer.

The discontinuities may be formed separate from the diaphragm and attached to the diaphragm, as shown in FIGS. 10 and 10A, or may be formed within the diaphragm, as shown in FIGS. 2A and 2B. In an embodiment where the discontinuities are attached to the diaphragm, the discontinuities may be stamped from flat sheet stock, bent into shape, and adhered to the diaphragm surface using epoxy or other adhesive. Other methods of creating the discontinuities and including the discontinuities on the diaphragm may be utilized as well.

Where the discontinuities are formed within the structure forming the diaphragm, as shown in FIGS. 2A and 2B, the breakup frequency of the diaphragm may be changed by adding a stiffening member 46 to the diaphragm at the junction of the discontinuities 38A, 38B, 44A, 44B. The stiffening member, in one implementation, is three dimensional such as to be formed as a nominal section of a cylinder. In other implementations, the stiffening member could be other shapes. The stiffening member in this implementation is attached to the diaphragm to span the junction of the discontinuities. For example, in FIG. 2, the stiffening member would span to attach to the four corners formed at the intersections of the discontinuities 38A, 38B, 44A, 44B. The stiffening member may be flat, concave to match the curvature of the diaphragm as shown in FIG. 2, convex relative to the curvature of the diaphragm, or another desired shape. The stiffening member 46 may be formed of aluminum, paper, or other suitable materials. The stiffening member 46 may be joined to the diaphragm via epoxy or another adhesive, or other rigid methods of attachment such as welding.

FIG. 2B shows a cross-sectional view of the example diaphragm shown in FIG. 2 taken along line 2B-2B. As shown in FIG. 2B, stiffening member 46 is attached to the diaphragm via, for example, an epoxy on opposite sides of the discontinuity 38. By attaching the stiffening member to each of the corners formed at the intersections of the discontinuities, it is possible to retain the stresses within the diaphragm largely in-plane rather than allowing the stresses to be converted to bending stresses. This enables the breakup frequencies to be increased when compared to an implementation that includes discontinuities but does not include a stiffening member.

FIGS. 7-14 are plan views of example diaphragms for use in an electro-acoustic transducer, and show several possible variations in configuration of the discontinuities. The example diaphragms in these figures are all racetrack in shape, although other shapes may likewise be used in connection with the illustrated and other discontinuity configurations. While the discontinuities in FIGS. 7-14 are described in the context of diaphragms, it should be readily understood that the discontinuities could also be applied to the dust cap, or other moving surfaces of an electro-acoustic transducer.

In FIG. 7, discontinuities 70, 71, 72, and 73 are of unequal length. Discontinuity 73 extends along a major axis from an apex 74 of a hemicircular end section of the diaphragm to a center of the diaphragm. Discontinuity 71 extends along the same major axis as discontinuity 73 toward an apex 75 opposite apex 74. However, discontinuity 71 terminates intermediate the center of the diaphragm and the apex 75. Discontinuities 70 and 72 collectively bisect the diaphragm in the longitudinal direction but have lengths that cause the discontinuities to terminate intermediately between the center of the diaphragm and an edge of the diaphragm. Various other lengths could be used for each of the discontinuities 70, 71, 72 and 73, and the lengths shown in FIG. 7 are merely exemplary.

Figure 8:
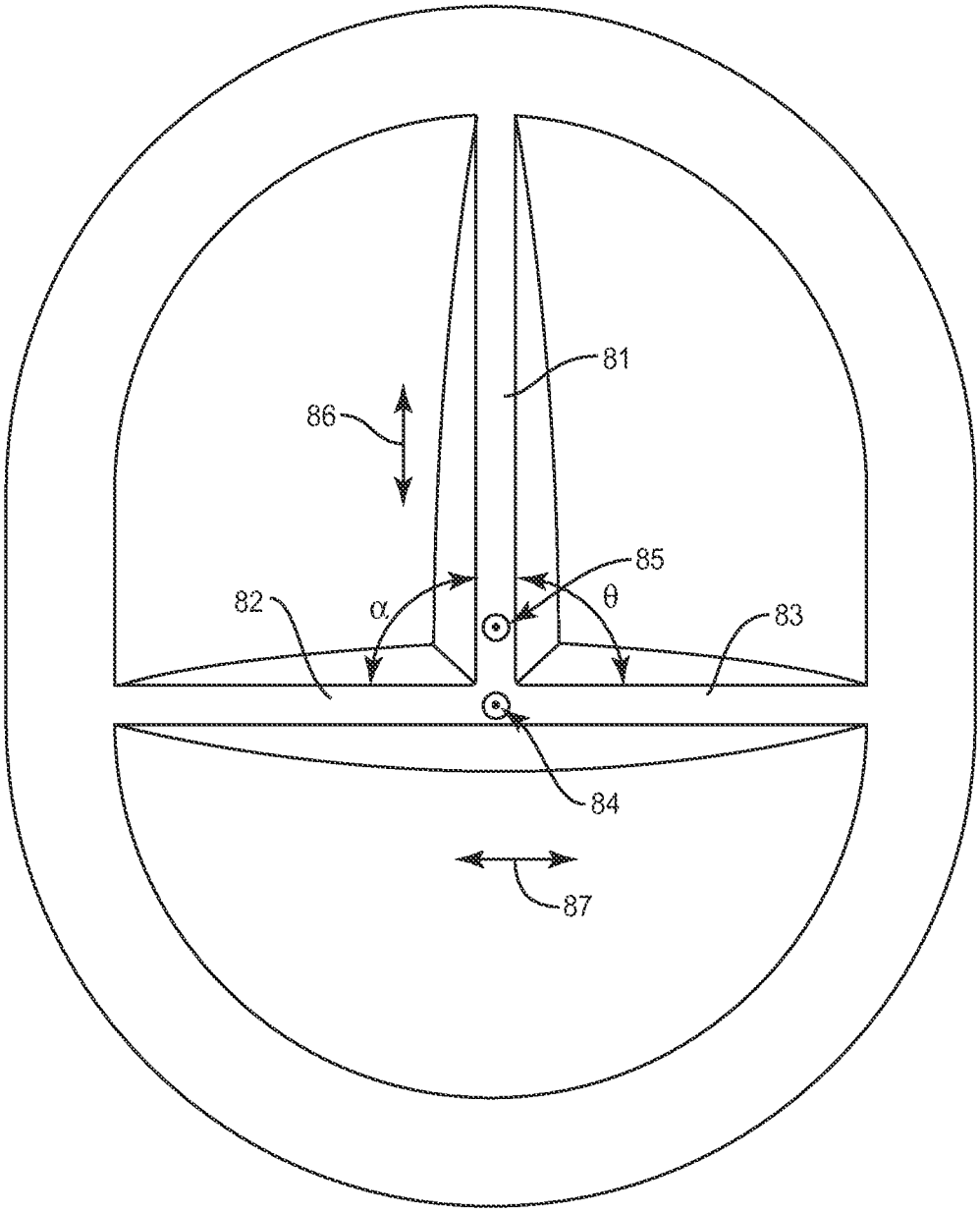

In FIG. 8, discontinuities 81, 82, 83 intersect at a location 84 that is not coincident with the geometric center 85 of the diaphragm. In this example, an angle $\alpha$ between discontinuities 81 and 82 is the same as an angle $\theta$ between discontinuities 82 and 83. Specifically, both angles are 90 degrees. Other angles may likewise be selected or differing angles may be utilized in other examples. In this example, the intersection location 84 is displaced from the geometric center in the longitudinal direction 86 only and is not displaced in a lateral direction 87. By moving the intersection away from the geometric center, breakup may be caused to be quasi-chaotic in nature, such that the overall response of the electroacoustic transducer may be smoothed when compared with a moving surface without discontinuities or when compared with a moving surface with regular discontinuities having an intersection coincident with the geometric center of the diaphragm.

Figure 9:
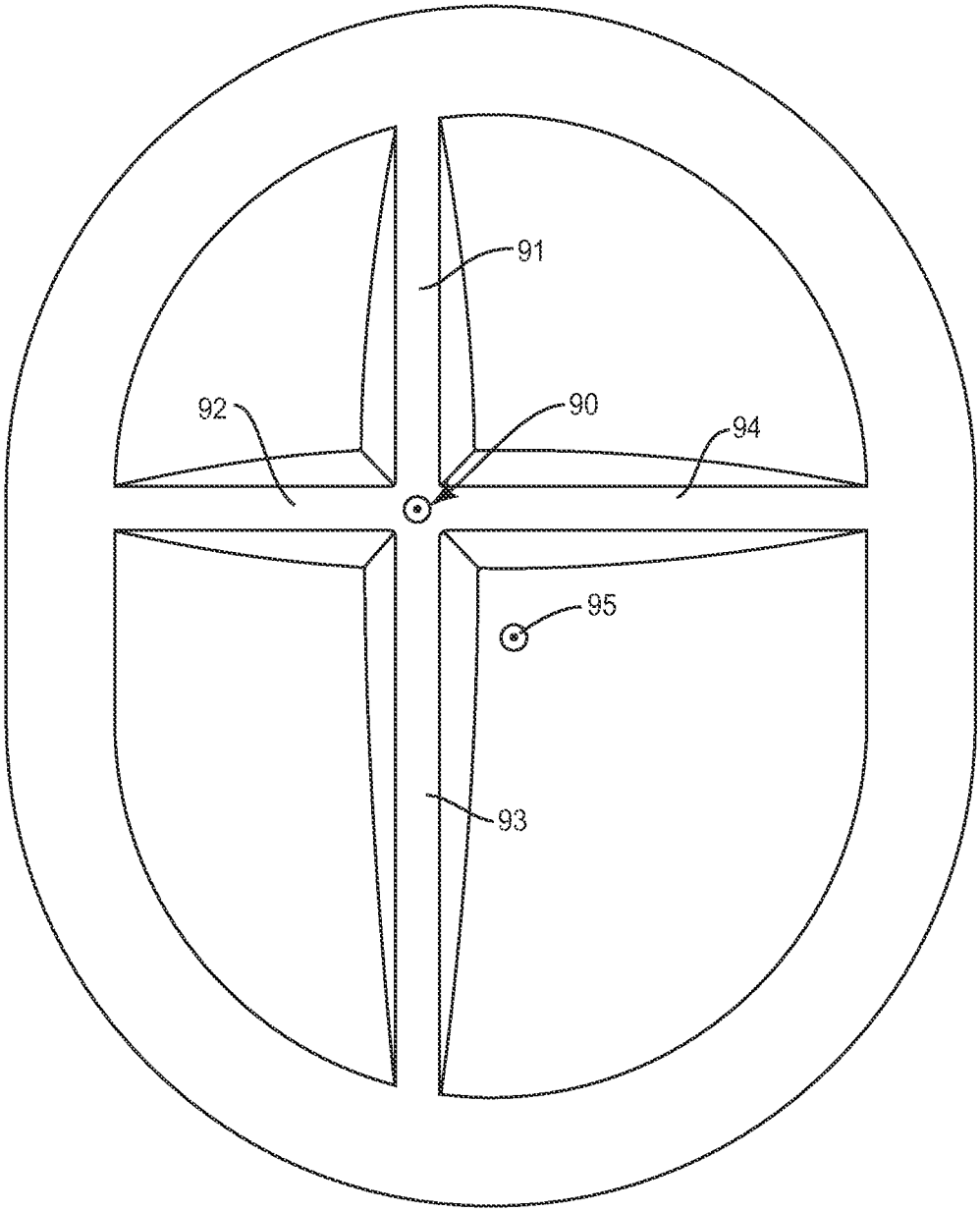

FIG. 9 shows another example where a location of an intersection 90 of discontinuities 91, 92, 93, 94 is displaced from a geometric center 95 of the diaphragm in both a longitudinal direction and lateral direction. In this example, the angles between the discontinuities are equal to provide regular azimuthal interval spacings between the discontinuities about the discontinuity junction point 90. As with the example in FIG. 8, by moving the intersection away from the geometric center, breakup may be caused to be quasi-chaotic in nature, such that the overall response of the electroacoustic transducer may be smoothed when compared with a moving surface without discontinuities or when compared with a moving surface with regular discontinuities having an intersection coincident with the geometric center of the diaphragm.

FIG. 10 shows an example where the discontinuities are formed separate from the diaphragm and attached to the diaphragm using epoxy or another adhesive. FIG. 10A is a cross-sectional view of the example diaphragm of FIG. 10 taken along line 10A-10A in FIG. 10. As shown in FIG. 10, the discontinuities 100, 101, 102 are shaped similarly to the discontinuities in the example shown in FIG. 8. However, in this example the discontinuities are shown to include projecting flanges 103 to facilitate adhesive bonding of the discontinuities to the diaphragm 104. The discontinuities also include voids 105 to permit easy formation from flat sheet stock.

FIG. 11 shows an example having discontinuities 110, 111, 112, 113 that intersect at more than one location. Specifically, in this example, discontinuities 110, 113 intersect at location 115, and discontinuities 111, 112 intersect at location 114. Intersection locations 114, 115 are offset by distance 116 that happens to be in a longitudinal direction. In other examples the offset may occur in the lateral direction instead of or in addition to the longitudinal direction. In the example shown in FIG. 11 the location 114 is coincident with a geometric center of the diaphragm. In other examples, both locations 114, 115 may be offset from the geometric center of the diaphragm.

Figure 12:
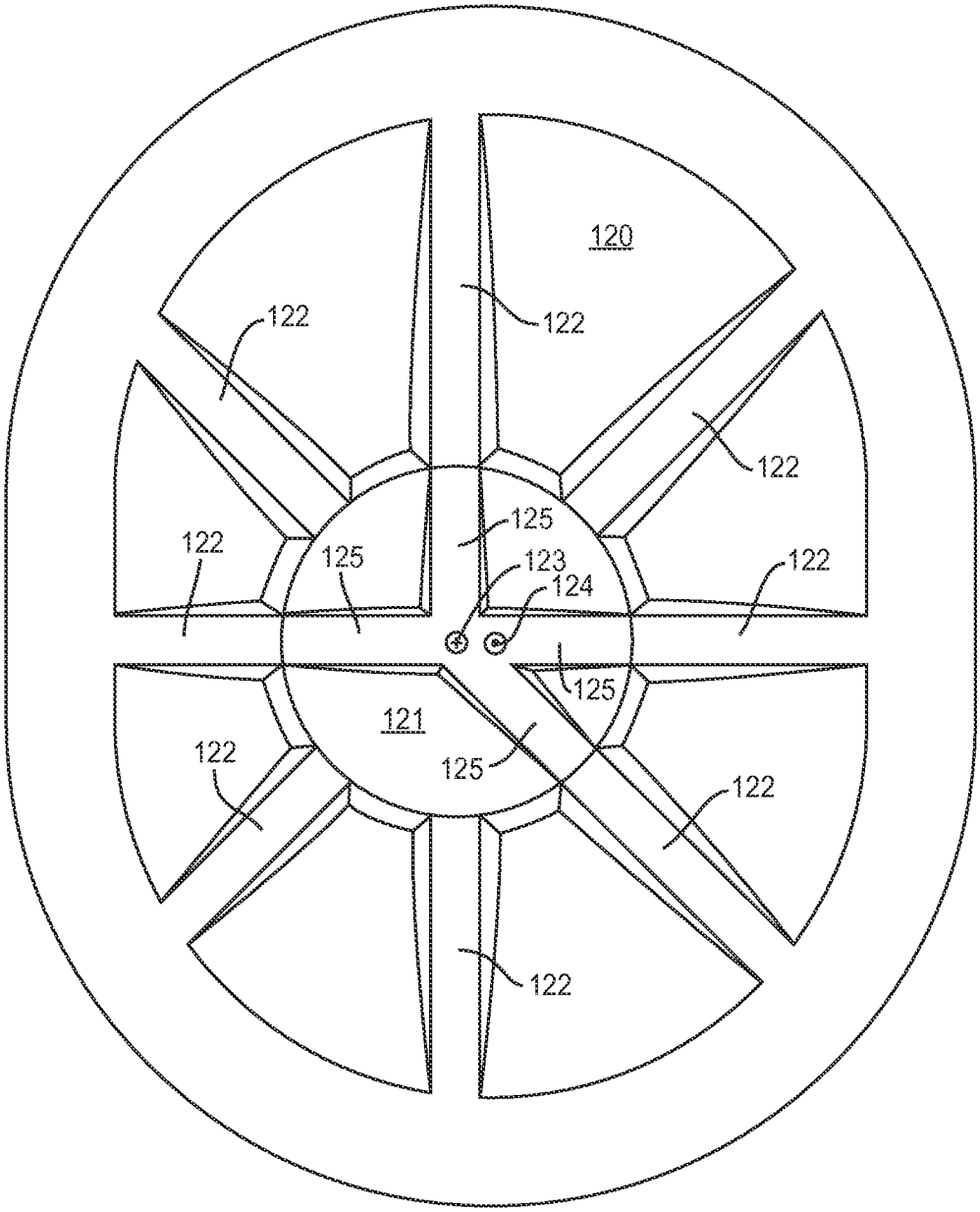

FIG. 12 shows an example diaphragm 120 with a Diaphragm Center (DC) 121 (which is not located at the geometric center of the diaphragm) and which is configured for attachment to a voice coil bobbin. Eight radiating discontinuities 122 are spaced at regular intervals around DC 121. DC 121 has a center 123 that is offset from a geometric center 124 of diaphragm 120. The DC is concave, relative to the diaphragm, and has its own series of discontinuities 125 that are independent of the discontinuities 122. Optionally, as shown in FIG. 12, one or more of the discontinuities 125 may be formed to align with one or more of the discontinuities 122. The discontinuities 125 have a junction at the center of the DC 121, but are not spaced at regular azimuthal spacings within the DC to thereby interrupt n-fold regular azimuthal symmetry within the DC 121.

Figure 13:
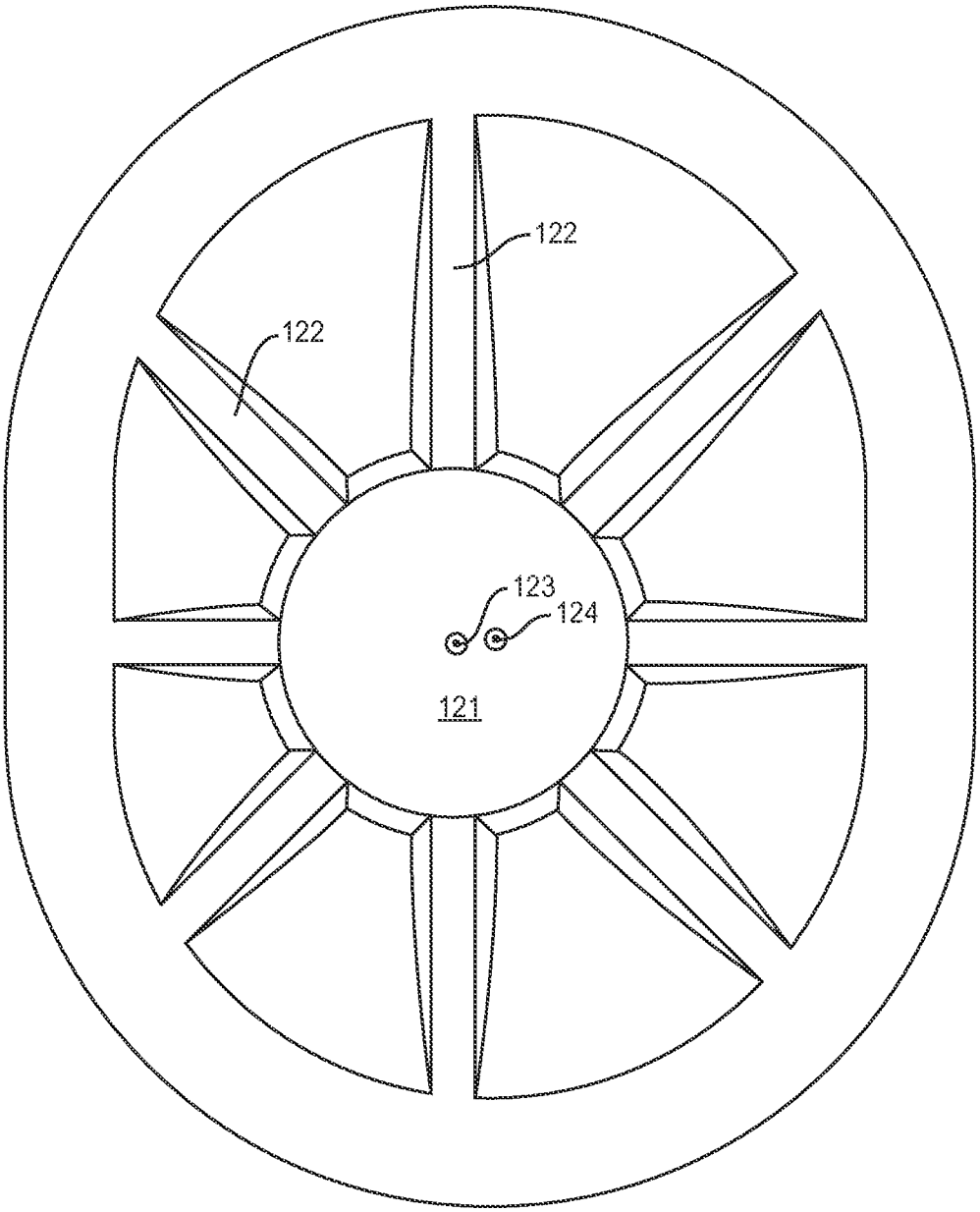

In FIG. 12, although discontinuities 122 radiate from the DC at regular intervals, centering the discontinuities at a location 123 offset from the geometric center 124 of the diaphragm interrupts n-fold regular azimuthal symmetry to create irregularity in breakup to smooth the electroacoustic transducer response. Likewise, including discontinuities 125 on DC 121 interrupts n-fold regular azimuthal symmetry within the DC 121 to further smooth breakup response. FIG. 13 shows an example similar to FIG. 12, but without discontinuities 125 in DC 121.

Figure 14:
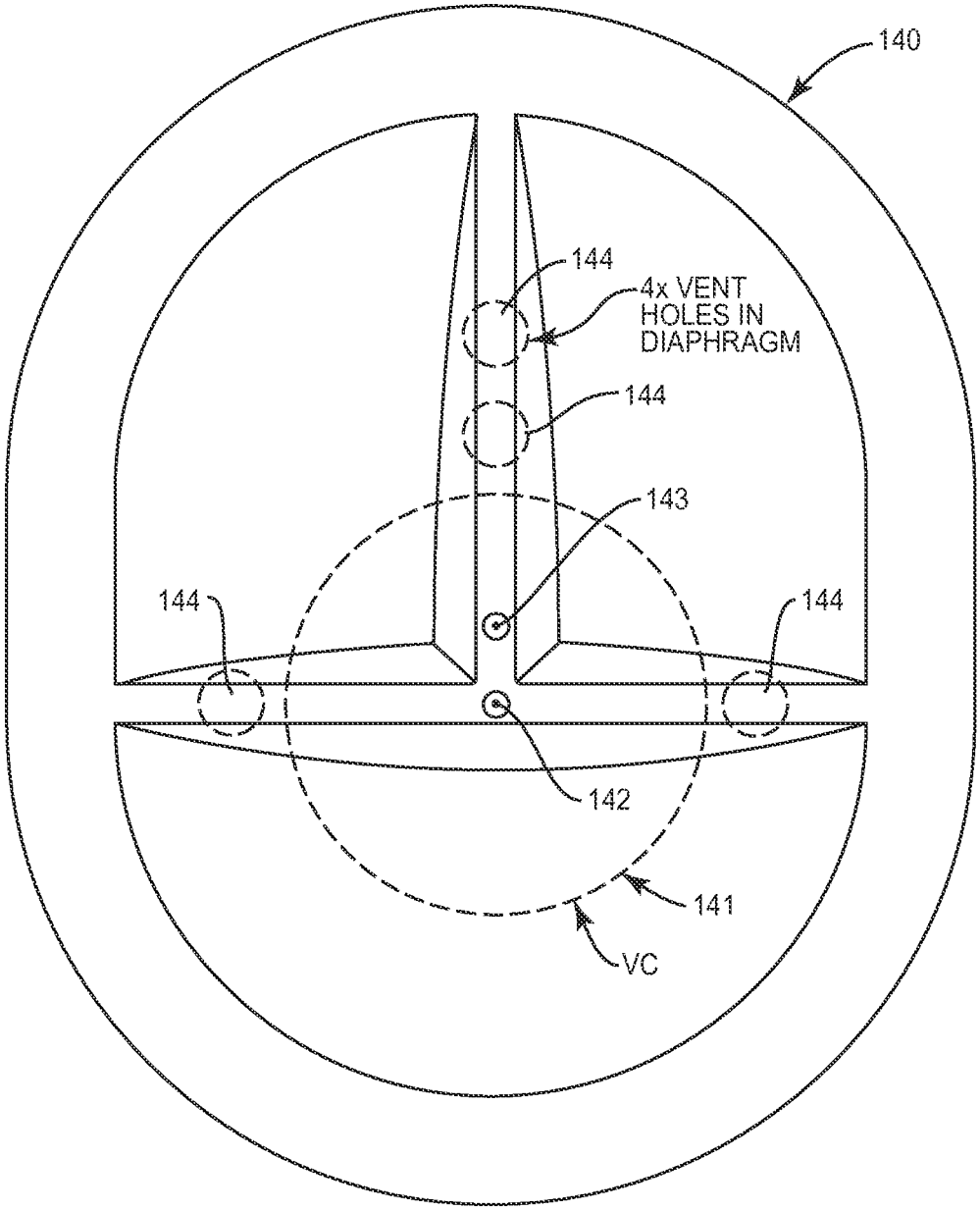

FIG. 14 is a plan view of an example similar to FIG. 8. FIG. 14 shows attachment of a voice-coil bobbin 141 to the diaphragm 140. As shown in FIG. 14, the voice coil may be joined to the diaphragm to be centered at a location 142 that is offset from a geometric center 143 of the diaphragm. The discontinuities in this example are attached to the diaphragm, e.g. by adhesively bonding the discontinuities to the diaphragm as explained in connection with FIG. 10. Apertures 144 are also provided to allow freedom of air motion into and out of the voice coil area as the speaker excurses. In this example, the interior sections of the discontinuities disposed between the voice coil and the apertures 144 form airflow ducts. As such the discontinuities are not necessarily closed into a complete box section for their entire length, but may be at least partially open to allow air to flow into and out of the discontinuities. In other examples, the apertures 144 may be formed to not coincide with the discontinuities.

In each of the examples described herein, discontinuities are provided that do not conform to a configuration having n-fold radial symmetry. This may be accomplished, as described herein, by using irregular azimuthal spacing and/or by having a junction point of the discontinuities offset relative to the geometric center of the moving surface (with regular or irregular azimuthal spacing). As such, the discontinuities may include any arrangement of ribs, grooves, corrugations, etc., that do not geometrically conform to a pattern of n-fold radial symmetry and/or where at least one junction of such discontinuities is not substantially coincident with the geometric center of the moving surface as defined by the outer perimeter of the moving surface. The geometric center, in this instance, may be considered from the front or rear view planar projected sense.

Figure 3:
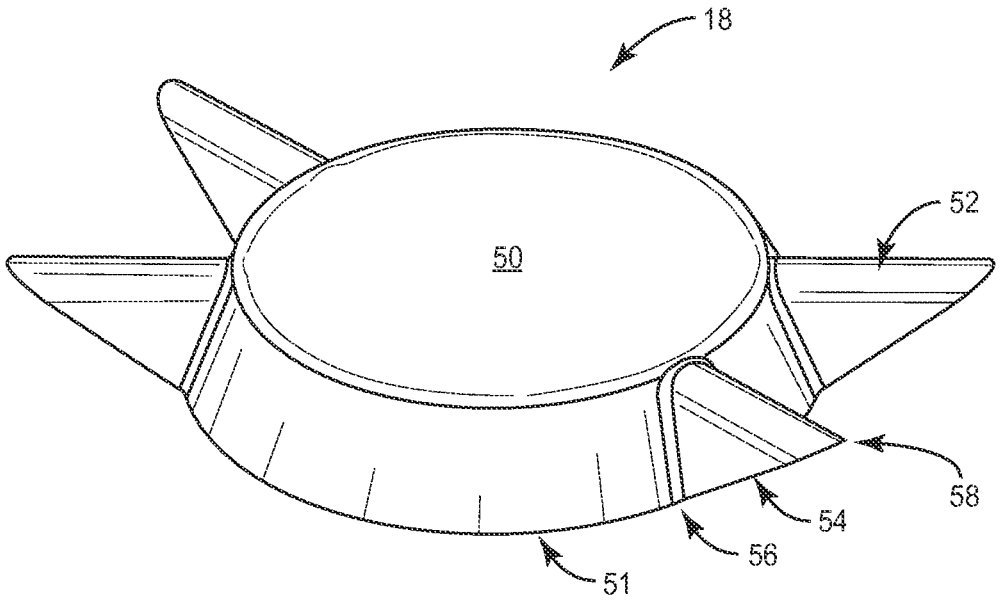
FIG. 3 is a perspective view of an example dust cap for use in an electro-acoustic transducer.

Although the previous description has focused on an example where discontinuities are applied to the diaphragm portion of the moving surface, in other examples the discontinuities described herein could also be applied to other moving sound producing components of the electro-acoustic transducer, including the dust cap. FIG. 3 shows an example dust cap 18 having a central area 50 that is generally circular in nature (though it could be other shapes including but not limited to an ellipse, square, rectangle, oblong, or racetrack). The central area 50 may be substantially flat, or it may be concave or convex. The dust cap 18 may have a lower edge 51 designed to intersect with a cone-shaped diaphragm. A plurality of wings 52 extend outward from the central area 50, spaced at irregular azimuth intervals. Although four wings 52 are shown in FIG. 3, any number of wings could be used. Each wing 52 has a lower edge 54 that is angled starting at a point 56 where the wing meets the lower edge 51 of the central area 50 and ending at a tip 58. The lower edge of the wing is designed to have an angle matching an angle of the cone-shaped diaphragm so that the lower edge of the wing engages the surface of the diaphragm along the length of the lower edge. Engagement between the lower edge of the wing and the diaphragm alters vibratory response of the diaphragm to alter the breakup characteristics of the diaphragm. The lower edge of the wing may rest on the diaphragm or may be connected to the diaphragm, e.g. adhered to the diaphragm via epoxy or another adhesive, depending on the implementation. As shown in FIG. 10, each lower edge may be extended to include a projecting flange 103 to facilitate adhesive bonding with the diaphragm. The dust cap could be constructed of aluminum, paper, or other suitable materials.

The wings 52 on the dust cap 18 are not placed at regular intervals in an azimuthal direction, but rather are spaced at irregular intervals such that at least two different azimuthal spacings are formed between pairs of wings. In one implementation the azimuthal spacings may be implemented to be formed at the same angle β described above. Imparting irregularly spaced axial wing interconnections between the dust cap and diaphragm enables quasi-chaotic disturbance of breakup modality to occur within the diaphragm to thereby smooth the frequency response from the diaphragm.

Figure 4:
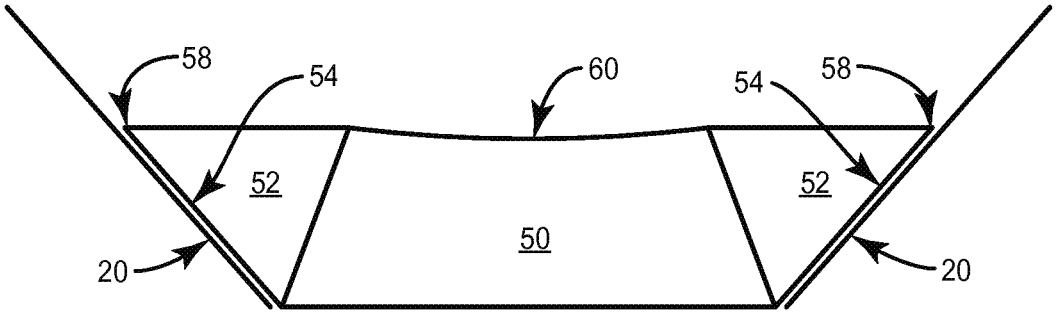
FIGS. 4-6 are side views of example dust caps and diaphragm for use in an electro-acoustic transducer.
Figure 5:
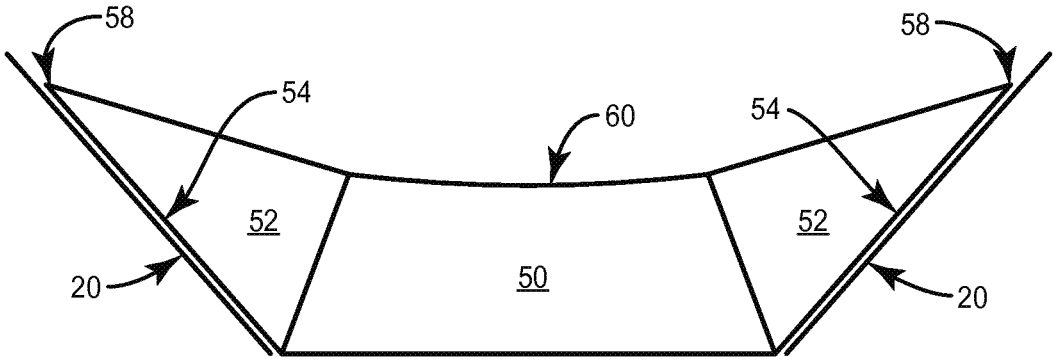
Figure 6:
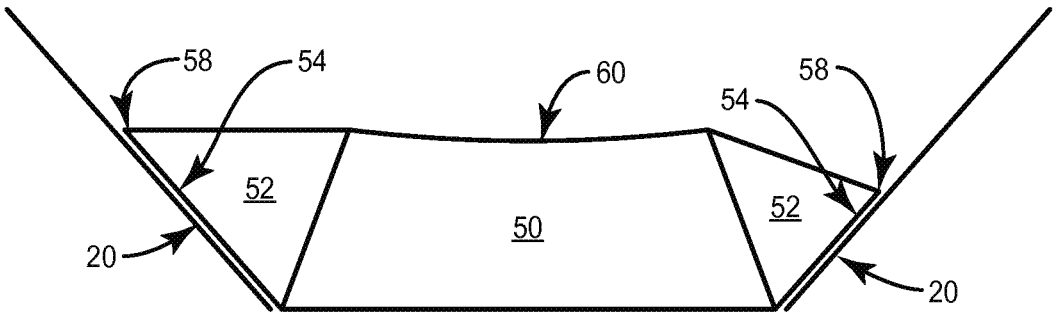

FIGS. 4-6 show several implementations of the dust cap in profile. In the implementation shown in FIGS. 4-6, dust cap 18 has central area 50 and irregularly spaced wings 52. As shown in FIG. 4, the lower edge 54 of wing 52 is disposed at the angle of the diaphragm 20 to contact the diaphragm substantially along its length. In FIGS. 4-6, the dust cap and diaphragm are shown in partial break-apart views such that lower edge 54 is shown slightly spaced above the diaphragm for ease of illustration. Any projecting flange attached to lower edge 54 included to facilitate adhesive bonding within the diaphragm is omitted in FIGS. 4-6 for ease of illustration. In operation, these components would contact each other such that the wings of the dust cap contact the surface of the diaphragm to disrupt breakup of the diaphragm.

The difference between the several implementations shown in FIGS. 4-6 are in the lengths of the wings. Changing the length of the lower edge of the wings affects how much contact occurs between the wings and the diaphragm. In the example shown in FIG. 4, the wings are designed such that the tips 58 of the wings are approximately at the same height as the height of a top surface 60 of the central area 50. The wings in FIG. 5 are designed such that the tips 58 of the wings are above the top surface 60 of the central area 50 such that the lower surfaces of the wings extend further up the surface of the diaphragm. The wings in FIG. 6 are designed such that some of the tips 58 of the wings are above the top surface 60 of the central area 50 and such that some of the tips 58 of the wings are below the top surface 60 of the central area 50. The shape of each wing, including its length, height, and width, will depend on the particular implementation. For example, longer wings may be used where the diaphragm is significantly larger than the dust cap, to enable the wings to have a greater impact on disruption of the breakup of the diaphragm. Likewise shorter wings may be used to minimize the weight of the dust cap where high frequency response is of primary concern. Thus, the particular wing shape and selection will depend on the overall implementation of the moving surface. In general, adjusting the length of the wings can modify the breakup resonant modes of the diaphragm to smooth the frequency response of the electro-acoustic transducer.

A number of implementations have been described. Nevertheless, it will be understood that additional modifications may be made without departing from the scope of the inventive concepts described herein, and, accordingly, other implementations are within the scope of the following claims.

What is claimed is:

1. An electro-acoustic transducer, comprising:

a moving surface comprising first and second transverse sections interconnecting first and second hemi-circular end sections;

a motor to move the moving surface to create acoustic waves;

at least two discontinuities formed in or in contact with the moving surface to radiate from at least one discontinuity junction toward an edge of the moving surface to disrupt breakup of the moving surface, the at least two discontinuities being constructed to not exhibit n-fold radial symmetry within the moving surface, wherein the at least two discontinuities include:

a first pair of discontinuities extending along a first major axis from the first hemicircular end section to the second hemi-circular end section; and a second pair of discontinuities bisecting the moving surface and the first pair of discontinuities and extending to the first pair of discontinuities at an intersection angle substantially other than 90 degrees, wherein the second pair of discontinuities extends from a first intersection between the first transverse section and the first hemi-circular end section to a second intersection between the second transverse section and the second hemi-circular end section.

2. The electro-acoustic transducer of claim 1, wherein the intersection angle is between 110 and 135 degrees.

3. The electro-acoustic transducer of claim 1, wherein the moving surface comprises a concave surface comprising sections that are nominal sections of a sphere.

4. The electro-acoustic transducer of claim 3, further comprising a voice coil attached to the moving surface at an off-center location.

5. The electro-acoustic transducer of claim 3, wherein the first and second pairs of discontinuities are formed as ribs in the concave surface.

6. The electro-acoustic transducer of claim 5, further comprising a reinforcing member at an intersection between the first and second pairs of discontinuities.

7. The electro-acoustic transducer of claim 6, wherein the reinforcing member is connected to the concave surface at four corners defined by the intersecting first and second pairs of discontinuities.

8. An electro-acoustic transducer, comprising:

a moving surface comprising first and second transverse sections interconnecting first and second hemi-circular end sections;

a motor to move the moving surface to create acoustic waves;

at least two discontinuities formed in or in contact with the moving surface to radiate from at least one discontinuity junction toward an edge of the moving surface to disrupt breakup of the moving surface, the at least two discontinuities being constructed to not exhibit n-fold radial symmetry within the moving surface, wherein the at least two discontinuities include:

a first pair of discontinuities extending along a first major axis from the first hemicircular end section to the second hemi-circular end section;

a second pair of discontinuities bisecting the moving surface and the first pair of discontinuities and extending to the first pair of discontinuities at an intersection angle substantially other than 90 degrees; and a reinforcing member at an intersection between the first and second pairs of discontinuities, wherein the moving surface comprises a concave surface comprising sections that are nominal sections of a sphere, wherein the first and second pairs of discontinuities are formed as ribs in the concave surface.

9. The electro-acoustic transducer of claim 8, wherein the intersection angle is between 110 and 135 degrees.

10. The electro-acoustic transducer of claim 8, wherein the second pair of discontinuities extends from a first intersection between the first transverse section and the first hemi-circular end section to a second intersection between the second transverse section and the second hemi-circular end section.

11. The electro-acoustic transducer of claim 8, further comprising a voice coil attached to the moving surface at an off-center location.

12. The electro-acoustic transducer of claim 8, wherein the reinforcing member is connected to the concave surface at four corners defined by the intersecting first and second pairs of discontinuities.

* * * * *